US008702573B2

(12) United States Patent
Hockridge et al.

(10) Patent No.: US 8,702,573 B2
(45) Date of Patent: Apr. 22, 2014

(54) GLUTE EXERCISE MACHINE WITH ROCKING USER SUPPORT

(75) Inventors: Bruce Hockridge, San Diego, CA (US); Randall T. Webber, La Jolla, CA (US); Jeffrey O. Meredith, San Diego, CA (US)

(73) Assignee: Hoist Fitness Systems, Inc., Poway, CA (US)

( * ) Notice: Subject to any disclaimer, the term of this patent is extended or adjusted under 35 U.S.C. 154(b) by 348 days.

(21) Appl. No.: 13/166,605

(22) Filed: Jun. 22, 2011

(65) Prior Publication Data

US 2012/0277069 A1 Nov. 1, 2012

Related U.S. Application Data

(60) Provisional application No. 61/479,646, filed on Apr. 27, 2011.

(51) Int. Cl.

| | |
|---|---|
| ***A63B 21/062*** | (2006.01) |
| ***A63B 21/068*** | (2006.01) |
| ***A63B 21/00*** | (2006.01) |
| ***A63B 71/00*** | (2006.01) |
| ***A63B 26/00*** | (2006.01) |

(52) U.S. Cl.

USPC ..... 482/100; 482/94; 482/137; 482/139; 482/142

(58) Field of Classification Search

CPC ..... A63B 21/1492; A63B 2208/0214; A63B 2208/0247; A63B 23/0216; A63B 23/0405; A63B 23/0482; A63B 23/0494; A63B 2023/0411; A63B 23/03541

USPC ..... 482/51, 78–80, 92–94, 97–103, 482/110–113, 121–139, 142–148

See application file for complete search history.

(56) References Cited

U.S. PATENT DOCUMENTS

| | | | |
|---|---|---|---|
| 3,820,782 | A | 6/1974 | Salkeld |
| 4,511,137 | A | 4/1985 | Jones |
| D321,390 | S | 11/1991 | Jones |
| 5,354,248 | A | 10/1994 | Rawls et al. |
| D357,288 | S | 4/1995 | Yang |

(Continued)

FOREIGN PATENT DOCUMENTS

| | | | |
|---|---|---|---|
| JP | 2008-79722 | A | 4/2008 |

OTHER PUBLICATIONS

Hoist CL-2412 Owners Manual, Hoist Fitness Systems, Jul. 2000, 43 pages.

(Continued)

*Primary Examiner* — Oren Ginsberg
*Assistant Examiner* — Joshua Lee
(74) *Attorney, Agent, or Firm* — Procopio Cory Hargreaves & Savitch LLP

(57) ABSTRACT

A glute exercise machine has a stationary main frame, a pivotally mounted upper torso support, a knee support, and an exercise arm having a foot support for engaging a user's foot and configured for rotation from a start position by user engaging the knee support with one leg and the exercise arm with the other leg. A connecting linkage translates movement of the exercise arms into rocking movement of the upper torso support. A load is linked to one of the moving parts to provide exercise resistance.

24 Claims, 13 Drawing Sheets

(56) References Cited

U.S. PATENT DOCUMENTS

| | | | |
|---|---|---|---|
| 5,409,440 | A | 4/1995 | Yang |
| 5,616,107 | A | 4/1997 | Simonson |
| 5,941,804 | A | 8/1999 | Johnston et al. |
| D431,615 | S | 10/2000 | Webber et al. |
| D438,918 | S | 3/2001 | Batca et al. |
| D446,831 | S | 8/2001 | Webber et al. |
| 7,331,911 | B2 | 2/2008 | Webber et al. |
| 7,335,140 | B2 | 2/2008 | Webber et al. |
| 7,361,125 | B2 | 4/2008 | Webber et al. |
| 7,442,153 | B1 | 10/2008 | Chasnov |
| 7,549,949 | B2 | 6/2009 | Webber et al. |
| 7,563,209 | B2 | 7/2009 | Webber et al. |
| 7,594,880 | B2 | 9/2009 | Webber et al. |
| 7,654,940 | B2 | 2/2010 | Webber et al. |
| 7,670,269 | B2 | 3/2010 | Webber et al. |
| 7,794,371 | B2 | 9/2010 | Webber et al. |
| 7,794,372 | B1 | 9/2010 | Webber et al. |
| 7,867,149 | B1 | 1/2011 | Webber et al. |
| 7,938,760 | B1 | 5/2011 | Webber et al. |
| 7,993,251 | B1 | 8/2011 | Webber et al. |
| 2004/0209750 | A1* | 10/2004 | Parmater ..... 482/123 |
| 2006/0003873 | A1 | 1/2006 | Kobayashi |
| 2010/0120590 | A1* | 5/2010 | Inaizumi ..... 482/99 |
| 2011/0207584 | A1 | 8/2011 | Webber et al. |
| 2011/0224052 | A1 | 9/2011 | Webber et al. |
| 2011/0224058 | A1 | 9/2011 | Webber et al. |

OTHER PUBLICATIONS

Hoist S412 Glute Master Customer Catalog, Hoist Fitness Systems, Aug. 1994, 16 pages.

Extended European Search Report for related EP 12161782.3, dated Dec. 17, 2012, in 6 pages.

* cited by examiner

GLUTE EXERCISE MACHINE WITH ROCKING USER SUPPORT

RELATED APPLICATION

The present application claims the benefit of co-pending U.S. provisional patent application No. 61/479,646 filed Apr. 27, 2011, which is incorporated herein by reference in its entirety.

BACKGROUND

1. Field of the Invention

This invention relates generally to exercise machines, and is particularly concerned with a glute exercise machine.

2. Related Art

In a glute muscle exercise, a user in a kneeling position kicks one leg backward and upward in order to exercise the gluteus muscles. Glute machines are known which allow a user to isolate the glute muscles and add exercise resistance to the leg movement. In one type of glute machine, the user rests their arms on a stationary upper body support, kneels with one knee on a stationary knee support, and engages a foot pad or the like on an exercise arm with the opposite foot. The foot is then pushed outwards and upwards to actuate the exercise arm and perform a glute exercise.

Since the user is in a fixed position on the user support during the glute exercise, the upper torso cannot move as the leg is kicked backward and upward, which may result in stress to the back muscles and does not produce optimum contraction of the gluteus muscles.

SUMMARY

A glute exercise machine in one embodiment has a main frame, an upper torso support movably mounted relative to the main frame and configured to support the upper torso of a user, a knee support configured to support the right or left knee of a user, the upper torso support and knee support together supporting a user in a glute exercise position, an exercise arm carrying a foot rest and movably mounted relative to the main frame, the foot rest configured for engagement by the foot of one leg of a user during a glute exercise while the other leg engages the knee support, a connecting linkage which translates movement of the exercise arm during a glute exercise into rocking movement of the upper torso support, and a load which resists movement of at least one of the exercise arm, connecting linkage, or user support. In one embodiment, the knee support is pivotally mounted on the frame for rotation about a vertical axis between left and right knee supporting positions.

The combined movement of the user support and exercise arm provides a more comfortable and natural feeling exercise motion that constantly adjusts the position of the user during the exercise to reduce stress on muscles. The upper torso support is designed to rock downwards as the leg is rotated upward and rearward, reducing stress to the back muscles. The rocking motion of the user support during the exercise also makes the exercise more enjoyable for the exerciser.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Figure 1:
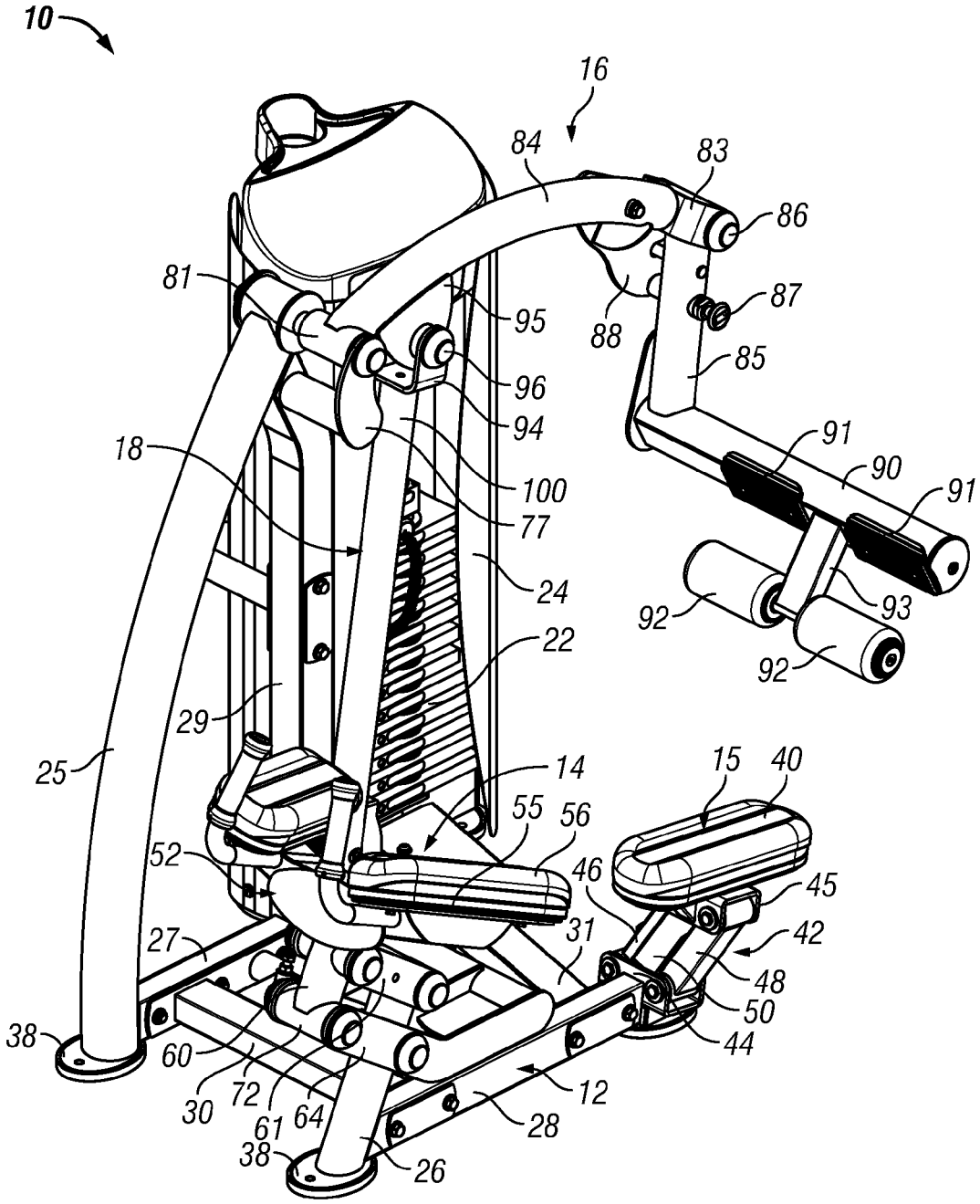
FIG. 1 is a front perspective view of a glute exercise machine according to one embodiment, with the machine in a start position for a glute exercise.

Certain embodiments as disclosed herein provide for a glute exercise machine with a rocking user support. Both the user support and the exercise arm move during an exercise, with a connecting linkage translating movement of the exercise arm to rocking movement of the user support so that the position of the user relative to a foot rest on the exercise arm is adjusted during the exercise.

After reading this description it will become apparent to one skilled in the art how to implement the invention in various alternative embodiments and alternative applications. However, although various embodiments of the present invention will be described herein, it is understood that these embodiments are presented by way of example only, and not limitation.

FIGS. 1 to 13B illustrate one embodiment of a glute machine 10 configured for exercising the gluteus muscles of a user. Machine 10 has a stationary, floor engaging main frame 12, a pivotally mounted user support or upper torso support 14, a pivotally mounted knee support 15, and a pivotally mounted exercise arm or user engagement device 16. A connecting linkage 18 including drive link 100 links movement of the exercise arm 16 to movement of the upper torso support 14. As illustrated in FIGS. 13A and 13B, a cable and pulley linkage 20 links the drive link 100 of the connecting linkage to a selectorized weight stack 22 in housing 24 positioned to one side of the machine, with other parts of the machine removed in FIGS. 13A and 13B so as to reveal the cable and pulley linkage. Thus, movement of the exercise arm together with the drive link is resisted by selected weights in weight stack 22, so as to provide resistance to rotation of the exercise arm during a glute exercise. The weight stack or other exercise resistance may alternatively be linked directly to the exercise arm, or to the upper torso support.

Figure 2:
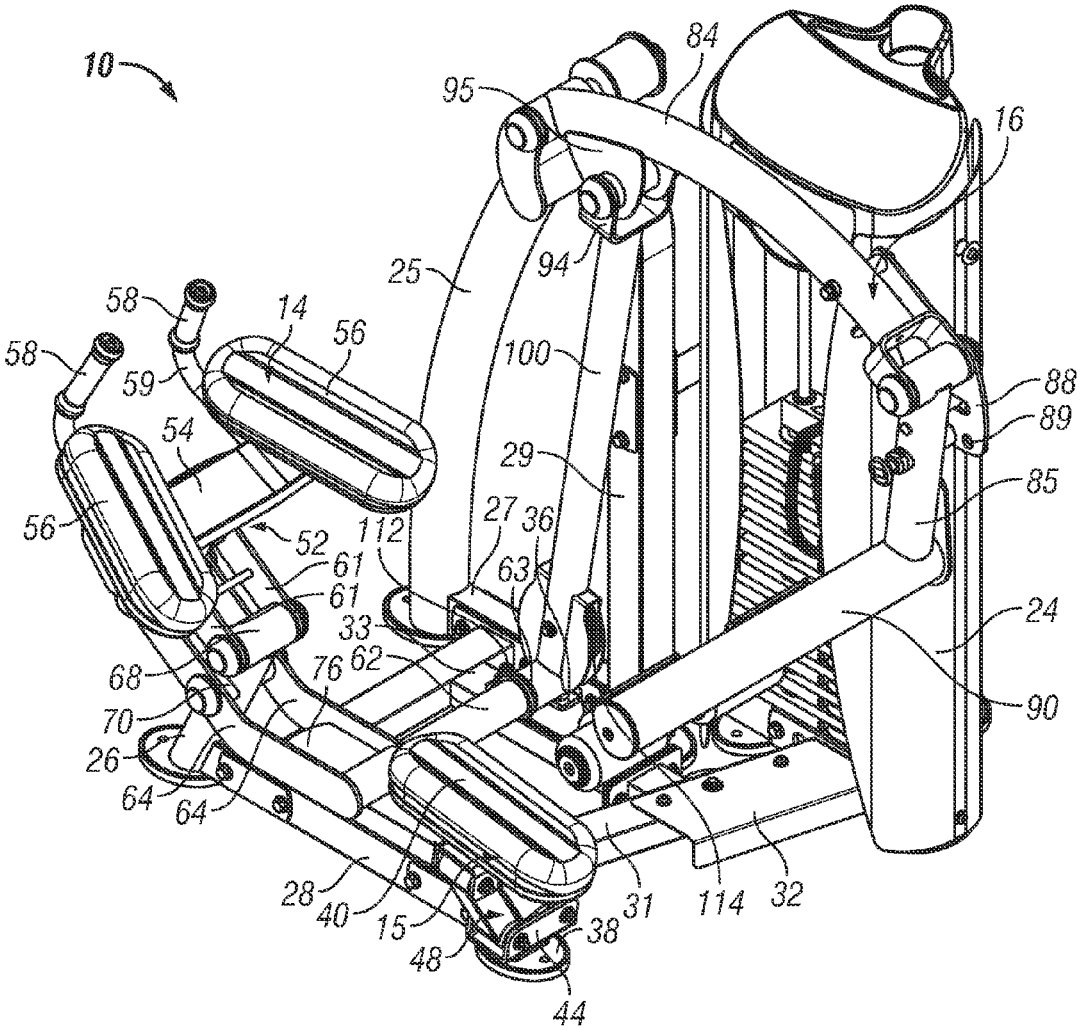
FIG. 2 is a rear perspective view of the machine in the start position of FIG. 1.
Figure 3:
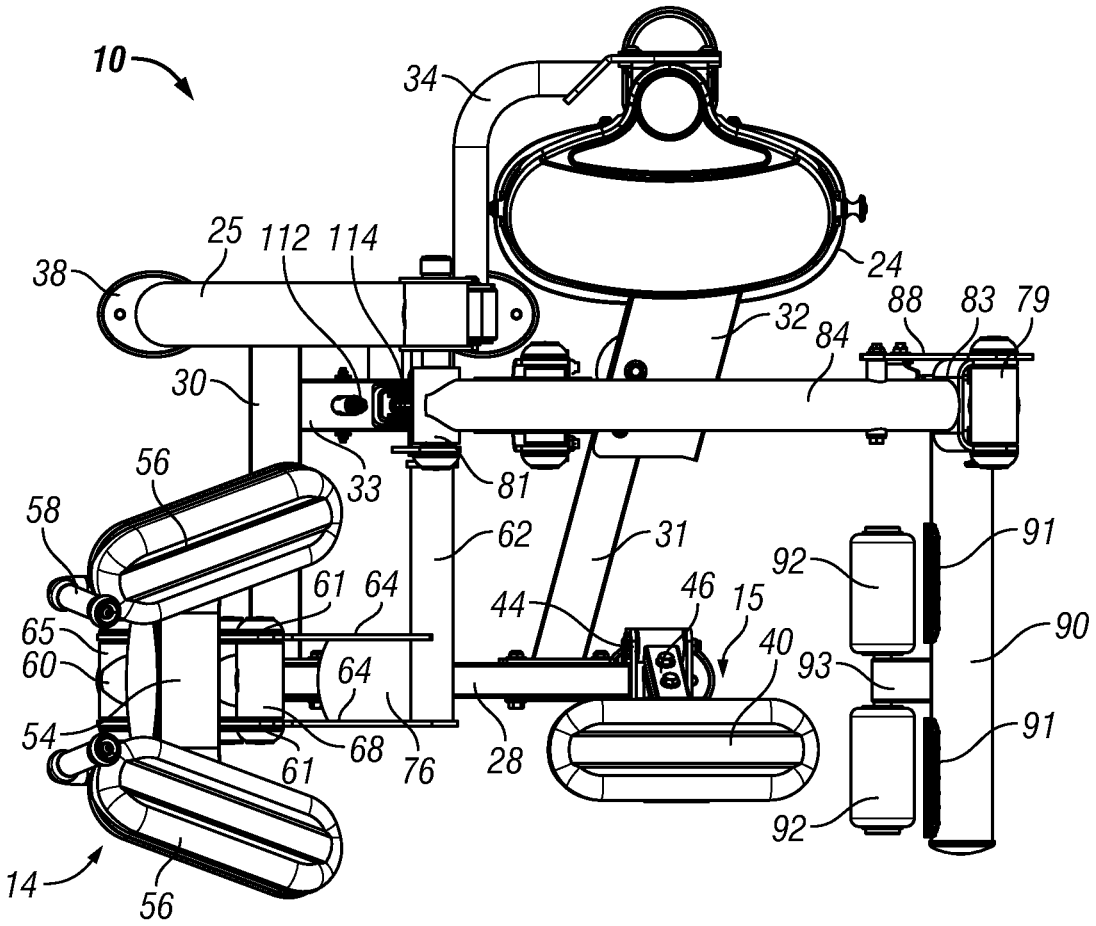
FIG. 3 is a top plan view of the machine of FIGS. 1 and 2.
Figure 6:
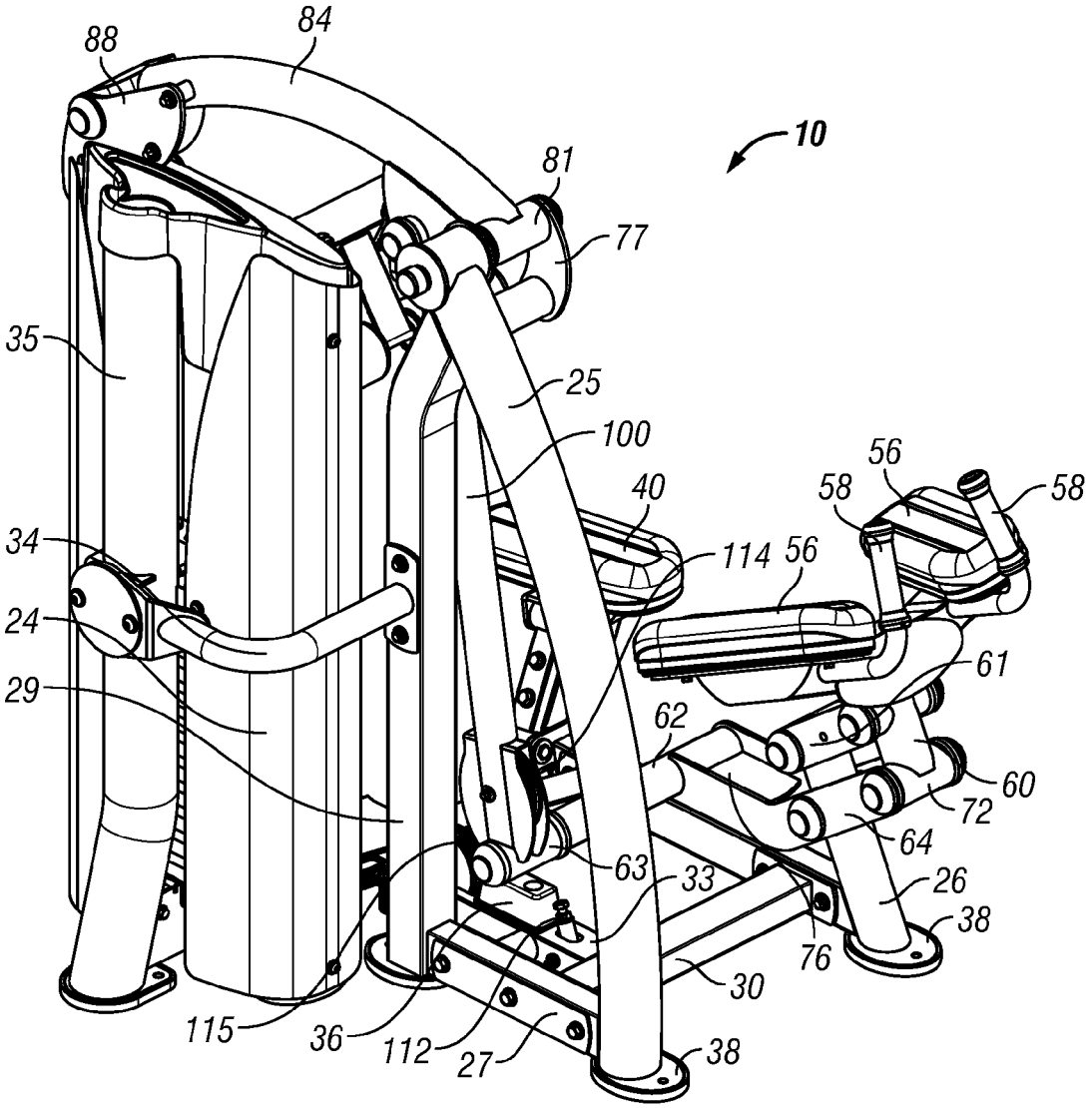
FIG. 6 is a side perspective view of the machine of FIGS. 1 to 5.

As best illustrated in FIGS. 1, 2, and 6, main frame 12 has a pair of front uprights 25, 26, parallel base side struts 27, 28 extending rearward from respective uprights 25, 26, an upright strut 29 extending upward from a location adjacent a rear end of base strut or tube 27, and a cross bar 30 extending between side struts 27, 28 and spaced to the rear of the front uprights 25, 26. A transversely extending rear base strut or cable guide tube 31 extends from side strut 28 and connects to the weight stack housing 24 via bracket 32, and a cable guide tube or connecting strut 33 extends from cross bar 30 to rear strut or guide tube 31. Front upright 25 is taller than front upright 26 and is pivotally connected to exercise arm 84 at its upper end, while the upper torso support 14 is pivotally supported on the shorter front upright 26, as described in more detail below. Weight stack housing 24 is secured to the main frame via base strut 31 and a support arm 34 which extends from upright strut 29 to a rear upright or cable guide tube 35 of the housing, as best illustrated in FIG. 6. Bumper pads 36 on guide tube 33 (see FIG. 6) and 75 on side strut 28 (see FIG. 8) define a rest position for the exercise arm 16 and drive link 100 and for the upper torso support, as described in more detail below. Ground engaging support feet 38 are provided at the lower ends of the upright strut 28 and front struts 25, and at the rear end of side strut 26.

Figure 5:
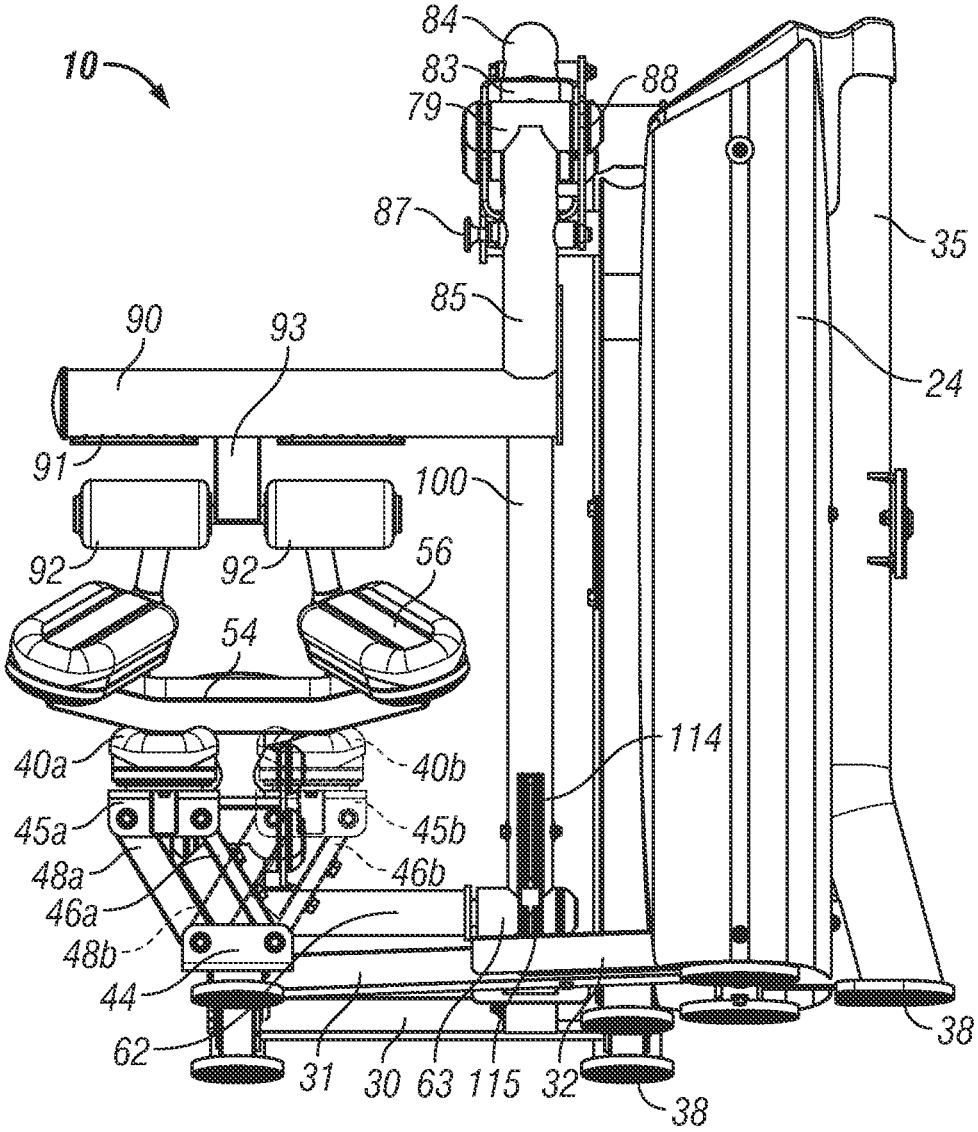
FIG. 5 is a rear elevation view of the machine of FIGS. 1 to 4, illustrating the right and left support positions of the knee support.

The knee support 15 comprises a knee pad 40 pivotally mounted at the rear end of main frame side strut 28 via a four bar pivot linkage 42 for side to side rotation between the right and left support positions illustrated in FIG. 5, with the right knee support position illustrated in dotted outline. The four bar pivot linkage 42 comprises a pivot base or first pivot bracket 44 secured to strut 28, a second pivot bracket 45 secured to the base plate of knee pad 40, and parallel pivot links 46, 48 each pivoted at one end to bracket 44 and at the other end to bracket 45. A thick bumper pad 50 of rubber or the like is secured to the inner face of pivot link 46 and engages the inner face of pivot link 48 in the right or left end positions illustrated in FIG. 5, stopping the knee pad in the proper position. This makes it easy for the user to rotate the knee pad back and forth between the right and left knee support positions, without having to index or pin the knee pad. Once rotationally adjusted, the links 46, 48 sandwich the bumper pad 50 which stops the knee pad in the correct position, with gravity alone holding the knee pad in place. FIG. 5 illustrates the left hand end position of the knee support in solid outline, with parts of the knee support identified by the letter A following the reference number, and the right hand end position of the knee support in dotted outline, with parts of the knee support identified by the letter B following the reference number. The distance between the left position 40A and the right position 40B of the knee pad is around 8.3 inches.

The upper torso support or support assembly 14 is best illustrated in FIGS. 1, 2, 4 and 6, and comprises a support frame 52 and a pair of inwardly angled side support plates 55 mounted at opposite ends of a cross bar 54 of support frame 52 and each carrying a respective arm support pad 56. A pair of stabalizing handles 58 are located in front of the respective arm support pads and are mounted on support arms 59 which extend forward from cross bar 56. A pivot strut or pivot mount 60 extends downwards from the center of cross bar 58 and is pivotally mounted via a first pair of pivot links 61 to the front upright 26 of the main frame and via a second pair of pivot links 64 to a cross bar 62 which extends transversely from the lower end of a drive link 100. The upper end of drive link 100 is pivotally connected to the forward end of exercise arm 16. Drive link 100, cross bar 62, and pivot links 64 together comprise the connecting linkage between the exercise arm 16 and upper torso support 14, as described in more detail below.

Figure 4:
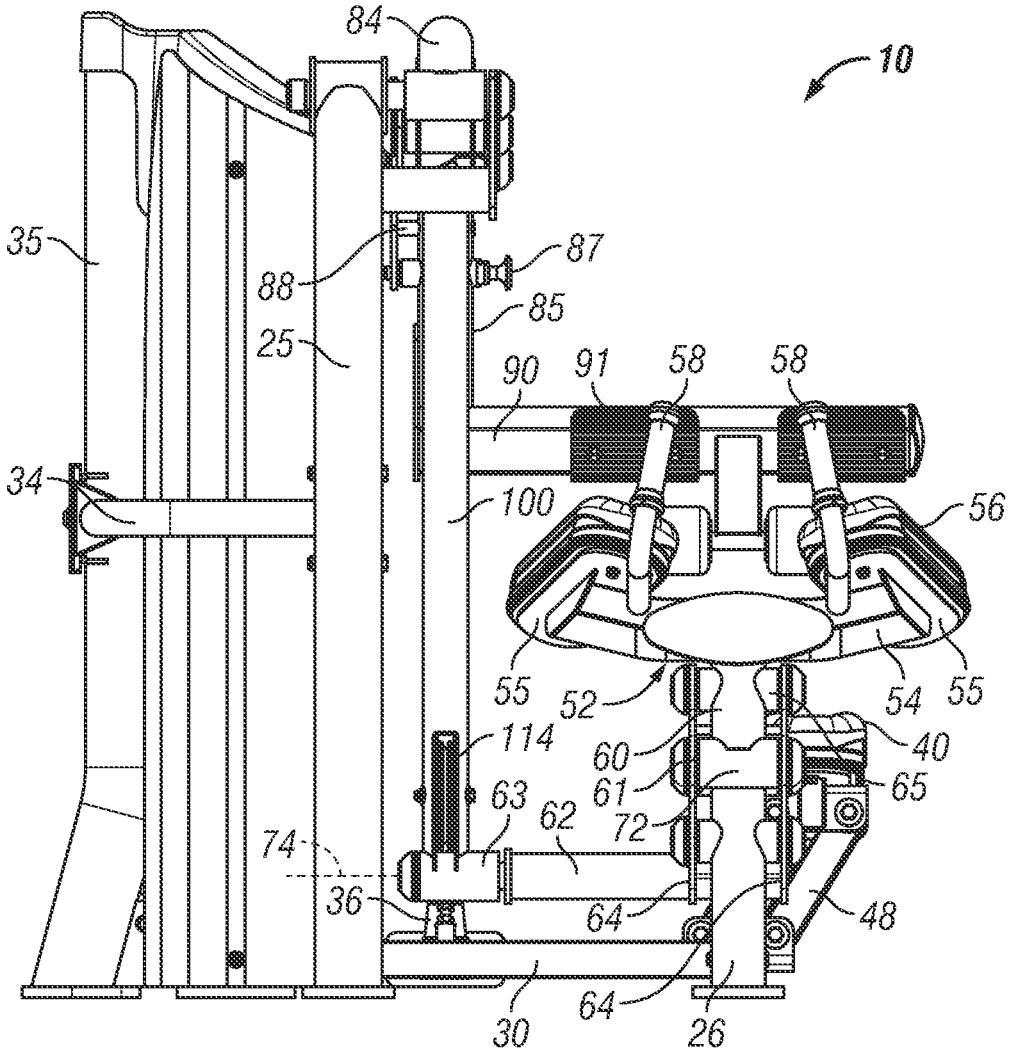
FIG. 4 is a front elevation view of the machine of FIGS. 1 to 3.

Cross bar 62 has an end pivotally engaged in pivot sleeve 63 at the lower end of the drive link, as best illustrated in FIGS. 4 and 6. Pivot links 64 are spaced below and parallel to pivot links 61 and the pivot links 61, 64 together form a parallel four bar pivot linkage which controls movement of the upper torso support between the start position of FIG. 7 and the lower, end position of FIG. 8. The first pair of parallel pivot links 61 are each pivoted at their first ends to pivot mount 60 via a pivot pin extending between the first ends of the pivot links through pivot sleeve 65 which is secured to pivot mount 60, defining a first user support pivot axis 66 (see FIGS. 7 and 8). The second ends of pivot links 61 are pivotally mounted at the upper end of main frame upright 26 via a pivot pin secured between the second ends of links 61 and extending through a pivot sleeve 68 secured to the upper end of upright 26, defining second user support pivot axis 69. The second pair of parallel pivot links 64 extend forward from the cross bar 62 and are pivoted to upright 26 at a location spaced below the first links 61 for rotation about third user support pivot axis 71 via a pivot pin extending through pivot sleeve 70. The forward ends of the pivot links 64 are pivoted to the lower end of pivot mount 60 via a pivot pin extending through pivot sleeve 72 at the lower end of pivot mount 60 for rotation about fourth pivot axis 73. The rear ends of the pivot links 64 are also pivotally linked to the lower end of a drive link 100 for rotation about pivot axis 74 defined by the rotatable engagement of the end of bar 62 in pivot sleeve 63, as illustrated in FIGS. 2, 4, 7 and 8. The pivot links 61 and 64 form a four bar pivot linkage controlling movement of the upper torso support relative to the main frame when the exercise arm is actuated, as discussed in more detail below. Bumper pad 36 on main frame support post 33 engages the pivot sleeve 63 to form a rest position for the drive link 100 and exercise arm in the exercise start position of FIGS. 1 to 7, as best illustrated in FIGS. 2, 4 and 6. The second bumper pad 75 located on side strut 28 engages a connecting plate 76 extending between the pivot links 64 (see FIGS. 2 and 3) to form a rest position for the upper torso support.

The exercise arm or exercise arm assembly 16 has a first arm portion 84 which is pivotally mounted at a forward end to the upper ends of main frame uprights 25 and 29 for rotation about pivot axis 82, and a second arm portion 85 which is adjustably secured to the rear end of arm portion 84. First arm portion 84 extends generally rearward from pivot 82 in the start position of FIGS. 1, 2 and 7, and second portion 85 has a pivot sleeve 79 pivoted to pivot bracket 83 at the rear end of portion 84 for rotation about adjustment axis 86 (see FIG. 7). Portion 84 has a pivot sleeve 81 at its forward end. A pivot pin (not visible in the drawings) extends from a pivot bracket 77 secured to the upper end of frame upright 29 through sleeve 81, to the upper end of forward upright 25. Portion 85 is secured at a selected angular position relative to portion 84 via a pull pin 87 extending through a selected aligned opening 89 in range of motion or ROM plate 88 which is secured to arm portion 84. A footrest 90 is secured to the lower end of the second arm portion 85 with a pair of foot capture safety rollers 92 secured to footrest 90 via spacer 93. Foot engaging pads 91 are provided on foot rest 90. The ROM adjustment allows the user to adjust the footrest start position for the user size. The upper end of drive link 100 is pivotally connected to the exercise arm at a location spaced rearward from pivot 84. As illustrated in FIGS. 1 and 2, a pivot bracket 94 at the upper end of drive link 100 is pivotally connected to pivot plates 95 depending downwards from exercise arm portion 84 for rotation about drive link upper pivot axis 96. When the exercise arm is in the start position of FIGS. 1, 2, 6 and 7, the user engaging footrest is in an easily accessible position for a user when they move onto the machine. The arrangement of the exercise arm, upper torso support, and connecting linkage is such that operation of the exercise arm by a user during an exercise results in movement of the upper torso support about the four bar pivot linkage on which it is mounted.

Drive link 100 is linked to selectorized weights in weight stack 22 by the pulley and cable linkage 20 as illustrated in more detail in FIGS. 13A and 13B. The cables of linkage 20 are omitted in the remaining drawings for clarity. As illustrated in FIG. 13A, cable 110 is attached to an anchor point 112 on main frame strut 33 (see FIG. 6) and extends from the anchor point around pulley 114 mounted at the lower end of drive link 100, then around pulley 115 on strut 33. From pulley 115, cable 110 extends through the end of strut 33 and into cable guide tube 31 and around pulleys in tube 31, and is then routed under the weight stack. The cable then wraps around a lower pulley 116 at the lower end of vertical guide or rear upright 35 of the weight stack housing to direct the cable upward. Cable 110 extends upward from lower pulley 116 to upper pulleys 119, 120, and then is directed downward to the top of the weight stack. It should be understood that one or more cables may be provided in the cable path from connecting link 100 to the top of weight stack 22, as best illustrated in FIG. 13B. Thus, resistance to movement of drive link 100, and resistance to movement of exercise arm 16 linked to the upper end of drive link 100, is provided by the selected number of weights in weight stack 22, and the user can adjust the amount of exercise resistance as desired.

Figure 7:
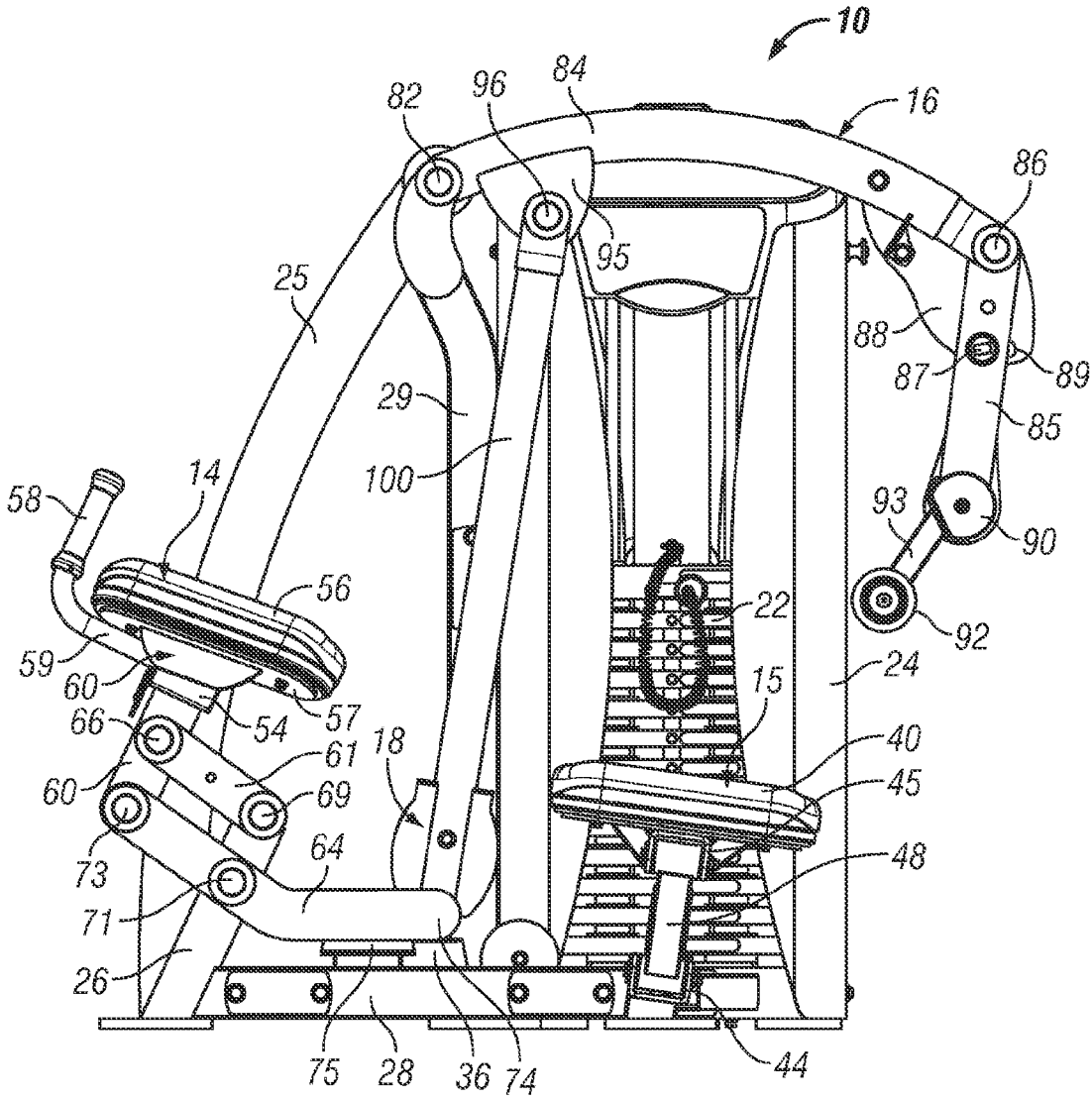
FIG. 7 is a side elevation view of the machine in the start position of FIGS. 1 to 6.
Figure 8:
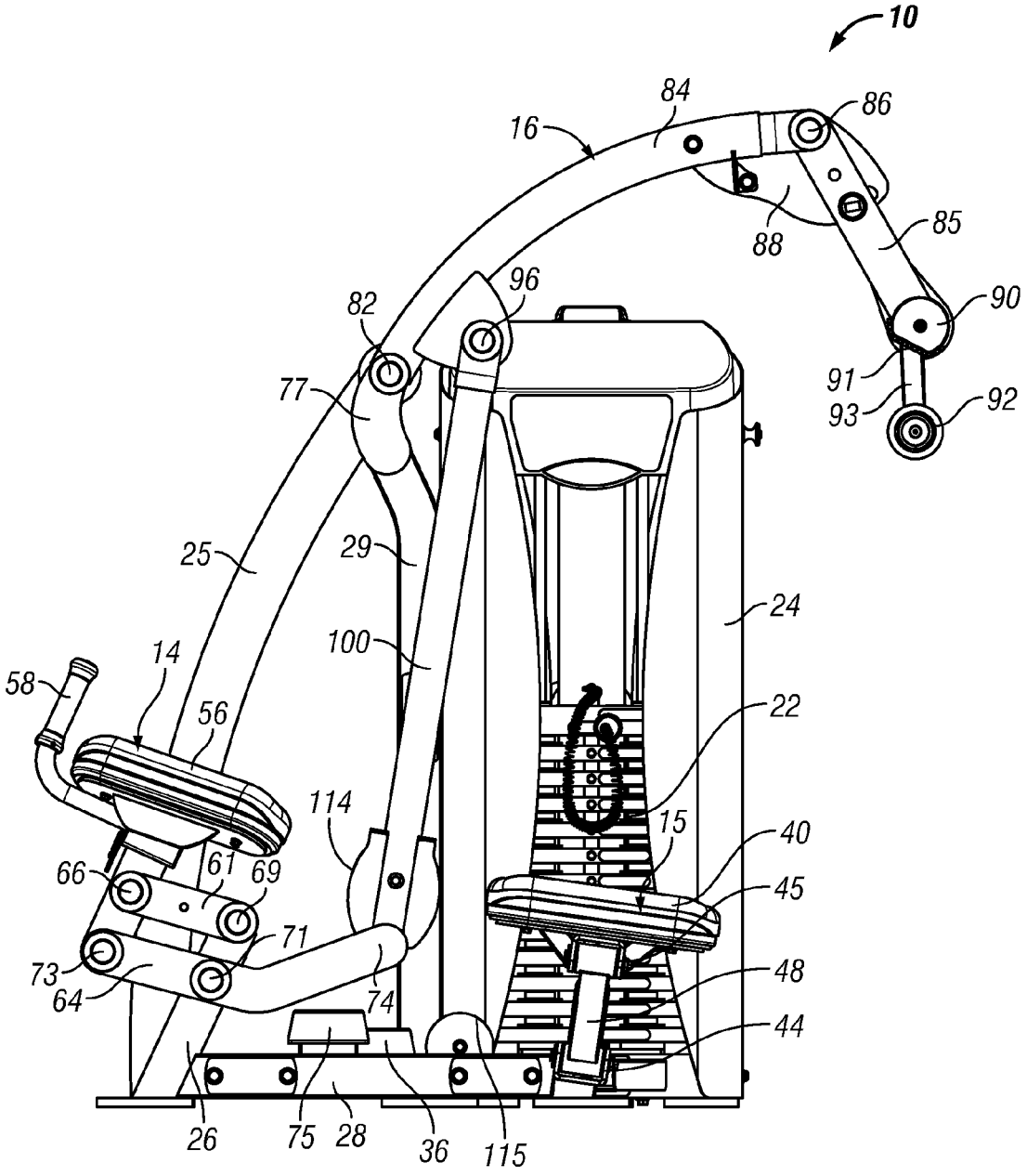
FIG. 8 is a side elevation view of the machine of FIGS. 1 to 7 in the end position for a glute exercise.
Figure 9:
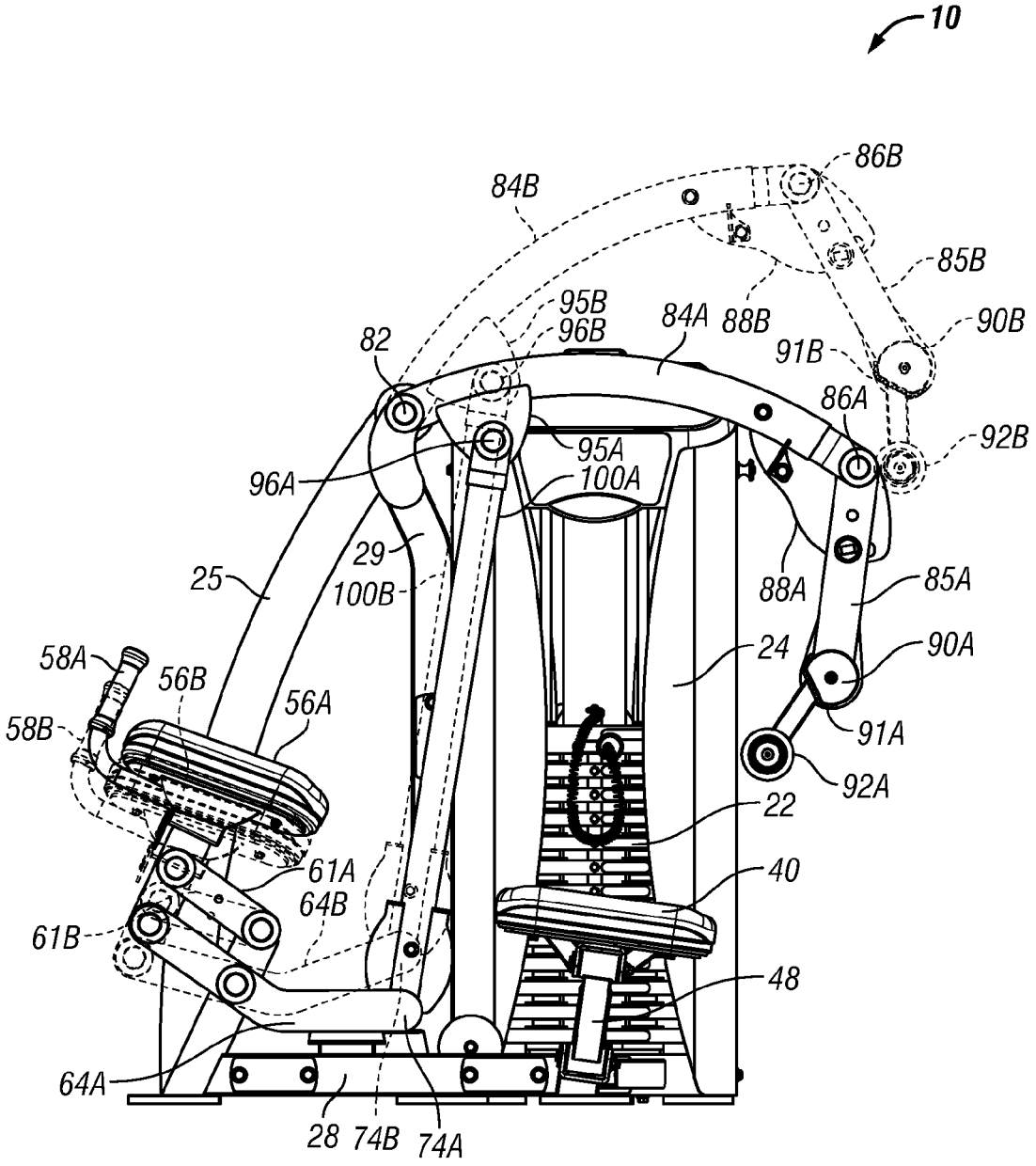
FIG. 9 is a side elevation view showing the two positions of FIGS. 7 and 8 superimposed, illustrating the movement paths of the various moving parts of the machine during an exercise.
Figure 10:
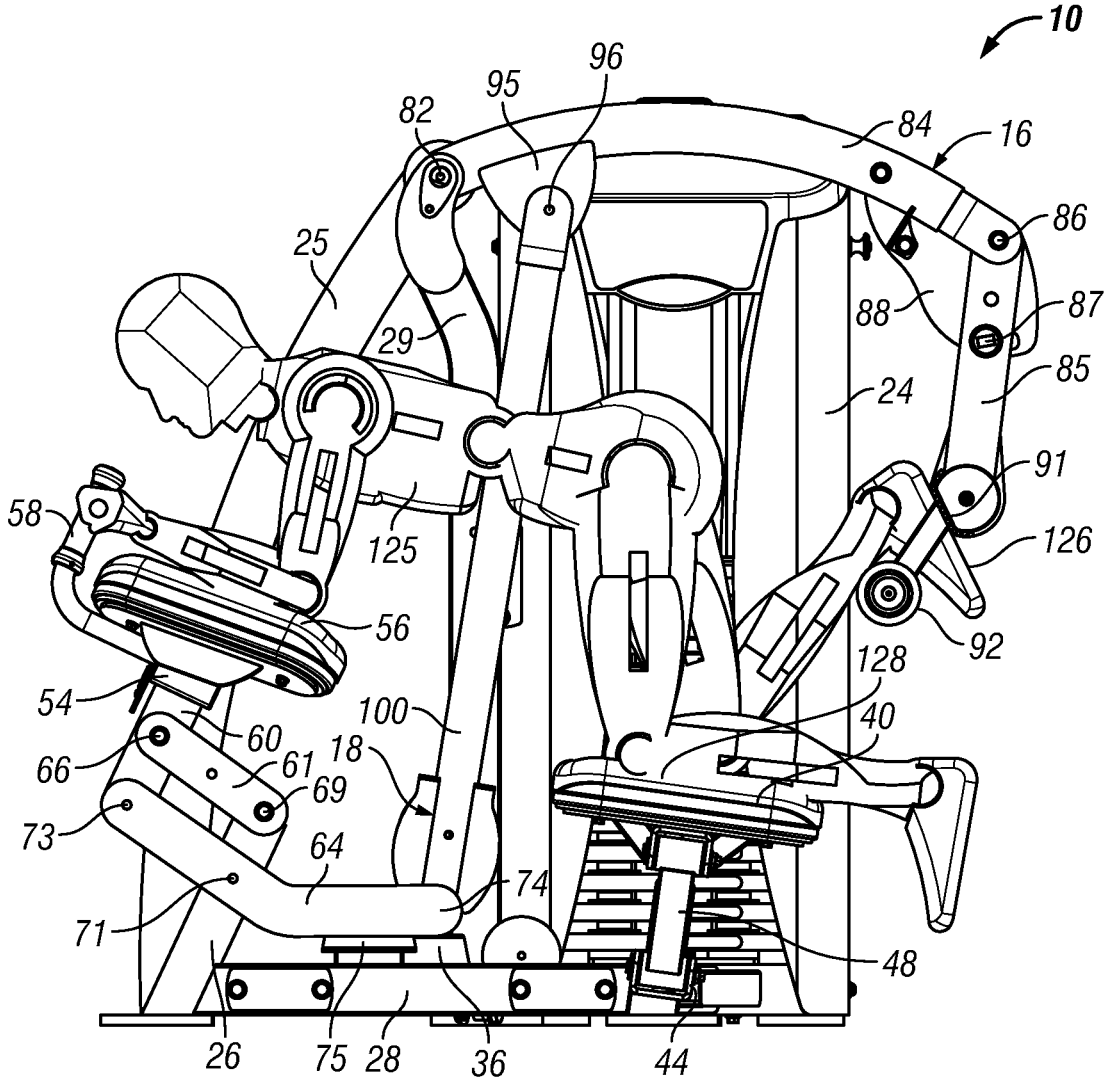
FIG. 10 is a side elevation view of the machine in the start position of FIG. 7 but with an exerciser positioned on the machine and ready to perform a glute exercise.
Figure 11:
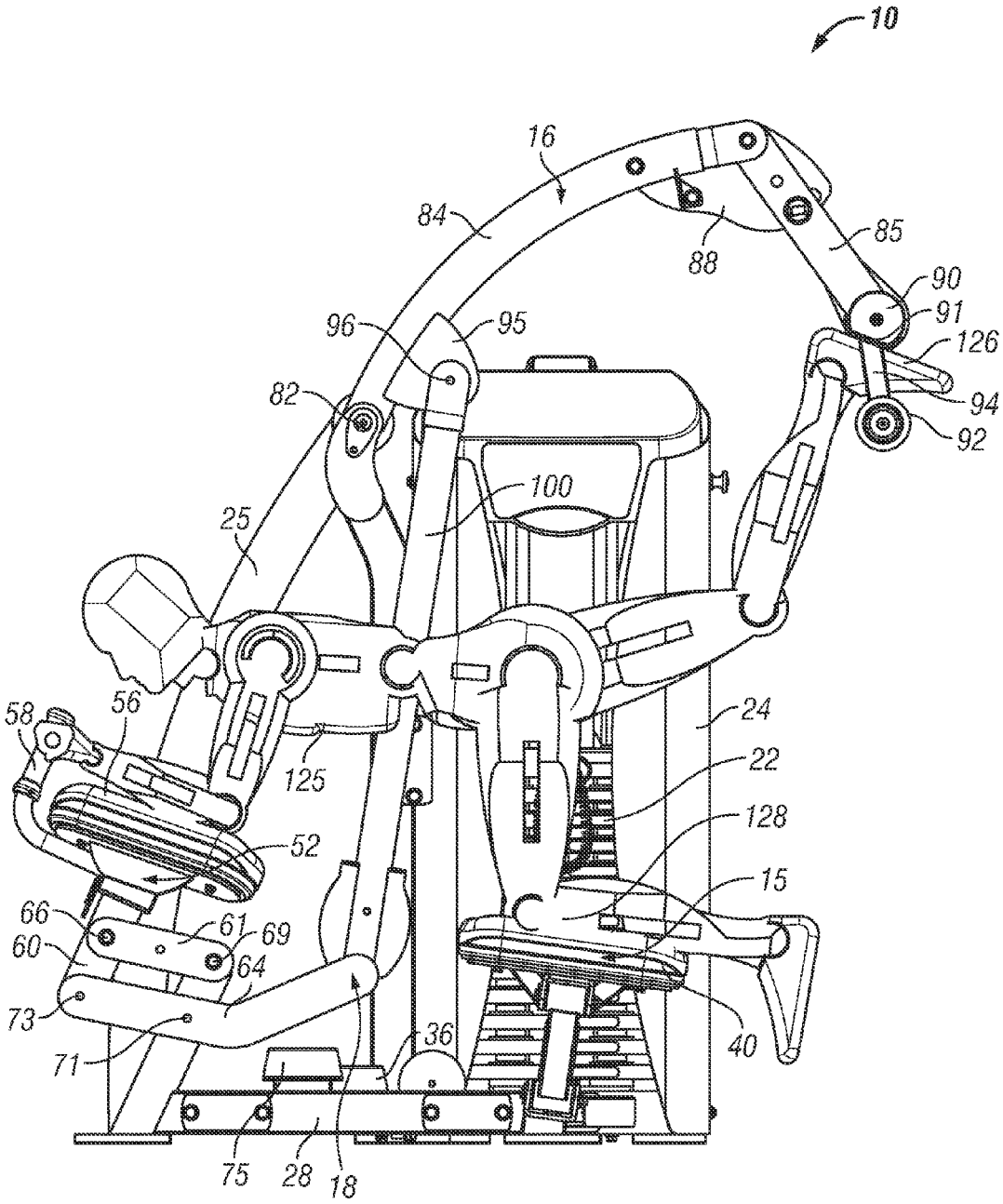
FIG. 11 is a side elevation view of the machine with an exerciser supported on the machine in the glute exercise end position of FIG. 8.
Figure 12:
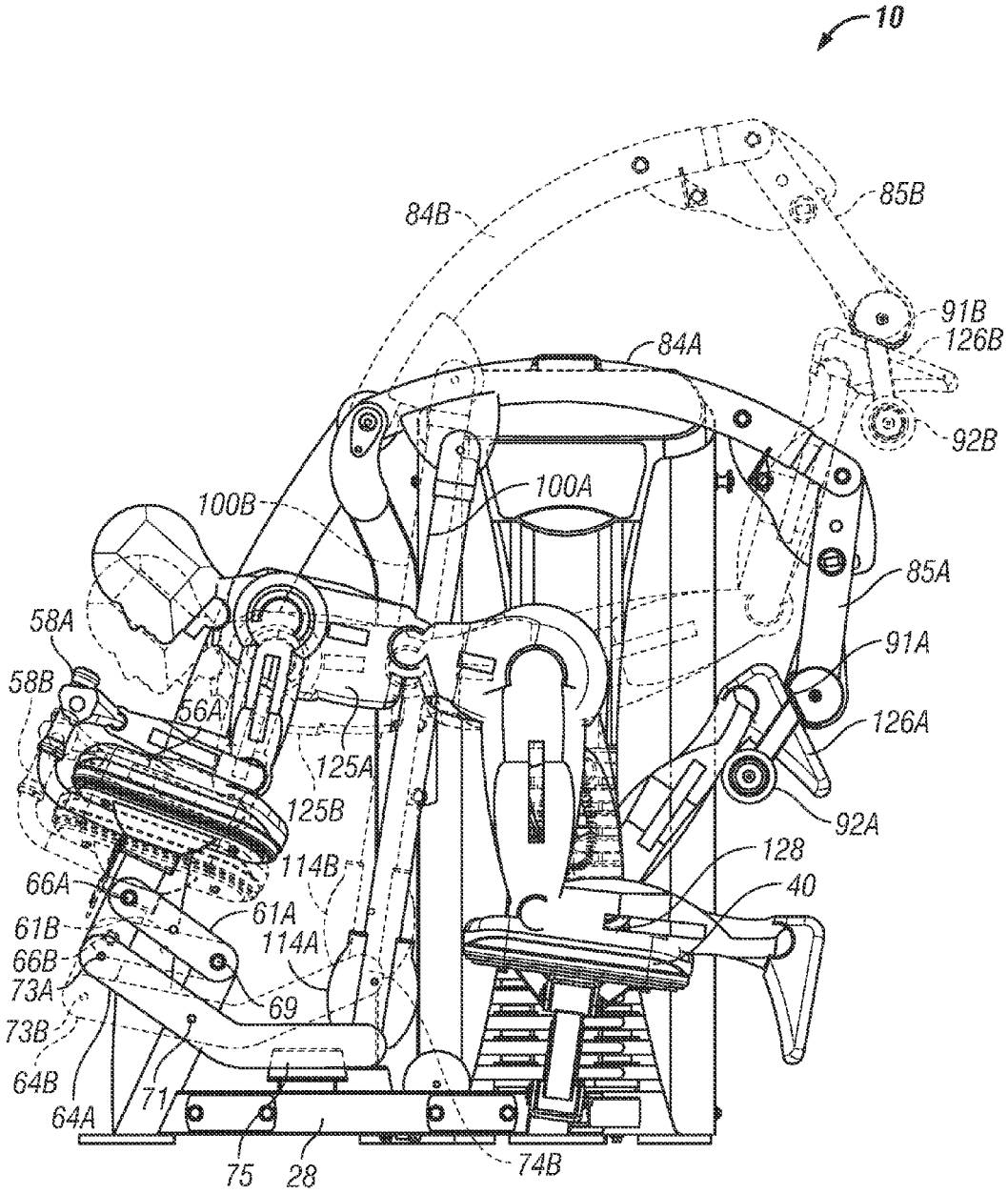
FIG. 12 illustrates the same superimposed side elevation view of the two positions of FIGS. 9 and 10 with the exerciser positioned on the machine and performing a glute exercise.
Figure 13B:
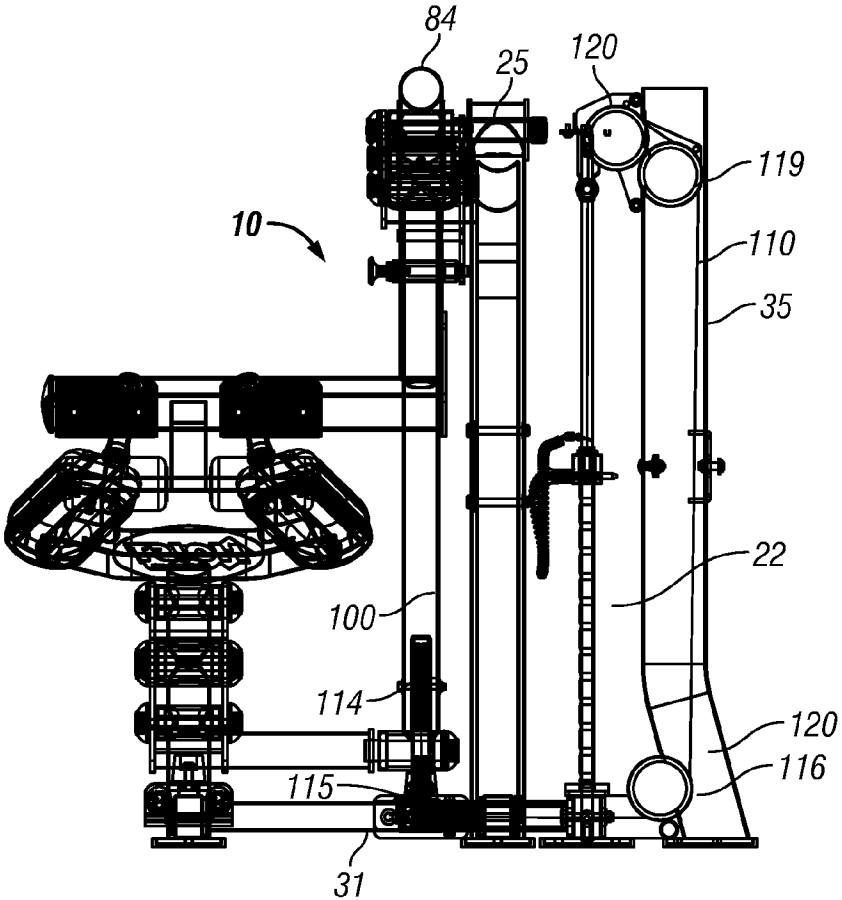
FIG. 13B is a rear elevation view similar to FIG. 13A also illustrating the cable and pulley linkage.
Figure 13A:
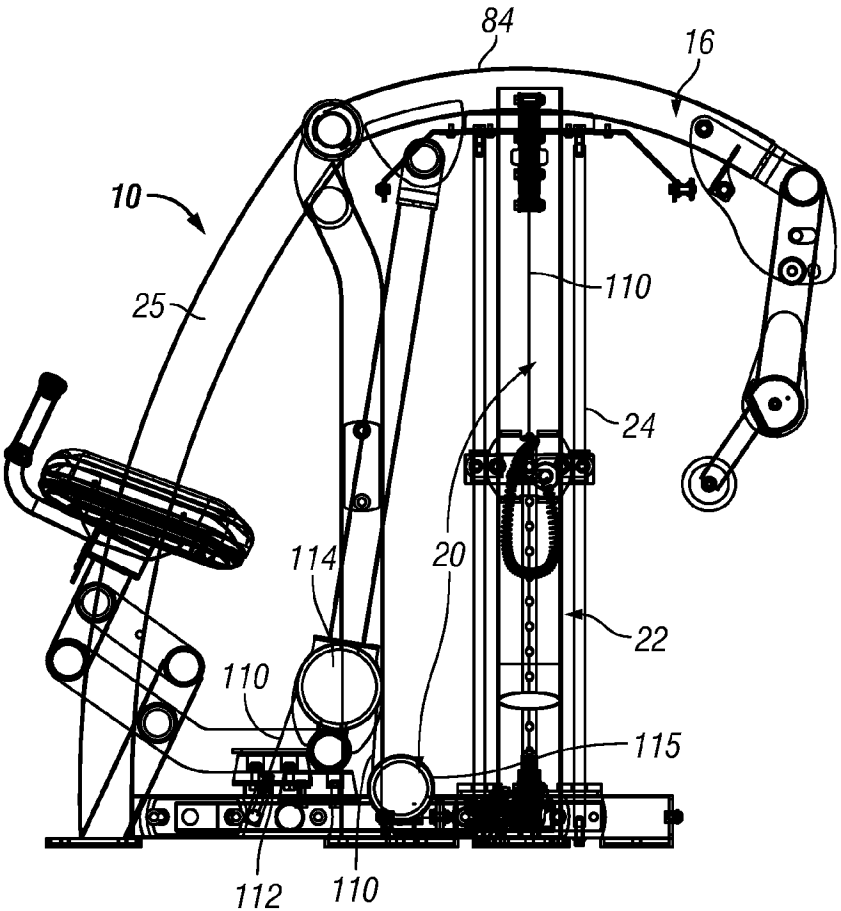
FIG. 13A is a side elevation view of the exercise arm assembly and weight stack of the machine of FIGS. 1 to 12, with the other parts of the machine removed, illustrating the cable and pulley linkage between the exercise arm assembly and the weight stack.

FIGS. 7 to 12 illustrate operation of exercise machine to perform a glute exercise in more detail, with FIGS. 10 to 12 illustrating a user 125 positioned on the machine and performing the exercise. FIGS. 7 and 10 illustrate the start position, FIGS. 8 and 11 illustrate one possible end position of a glute exercise, while FIGS. 9 and 12 illustrate the start and end positions superimposed with the end positions of the moving parts (and the user in FIG. 12) shown in dotted outline. In FIGS. 9 and 12, reference numbers followed by the letter A correspond to start positions and reference numbers followed by the letter B correspond to exercise end positions of the various moving parts. The actual end position is not fixed and varies from user to user depending on leg length and amount of extension used in performing a glute exercise. Thus, FIGS. 8, 9, 11 and 12 illustrate one possible end position for a glute exercise, and the amount of movement of the upper torso support also varies depending on how far the exercise arm is moved by the user in performing a glute exercise. The start or rest position of the exercise arm and upper torso support is determined by the pivot mounts and linkages and the engagement of the sleeve 64 and connecting plate 76 with bumper pads 36 and 75 which define the start or rest position for the exercise arm, connecting linkage, and upper torso support.

At the start of an exercise, the exercise arm and upper torso support are in the position illustrated in FIGS. 1 to 7 and 10, and in solid outline in FIGS. 9 and 12. In order to perform a glute exercise, the user first adjusts the footrest position so that they can reach the footrest with their foot when kneeling on knee support pad 40. This is done by releasing pull pin 87 from the aligned opening in ROM plate 88, rotating arm portion 85 about pivot 86 until the desired position is reached, and then releasing pin 87 to lock the arm portion 85 in the selected position. The user then assumes a kneeling position with one knee/shin on the knee support pad 40, and rests their arms on the upper torso support pads 56 while gripping stabilizing handles 58 for balance, as illustrated in FIG. 10. The non-kneeling leg is then raised up and rearward to position foot 126 between foot capture safety roller 92 and foot pad 91 of foot rest 90 so the foot can press against the footrest. The user is now in a position to start a glute exercise. In FIGS. 10 and 12, the user has positioned knee support 15 in the left hand position and has their left knee and shin 128 on the support pad 40, with the right foot 126 engaging the footrest 90.

When the user is in the exercise ready position of FIG. 10, the foot 126 is pressed against the footrest and lifted, so as to rotate the exercise arm upward about pivot axis 82. When the exercise arm is rotated upward, the drive link 100 is in turn lifted upwards, and forces the upper torso support 14 into motion. As the drive link 100 moves upward, the rear ends of pivot links 64 are also lifted upward and the forward ends of links 64 in turn are rotated downward about pivot axis 71, simultaneously pulling pivot mount 60 and cross bar 54 of the upper torso frame downward. This in turn rotates pivot links 61 about pivot axis 69 in parallel with links 64. This moves the upper torso supports 56 downward and slightly forward from the start position illustrated in FIGS. 7 and 10 to the end position illustrated in FIGS. 8 and 11. The corresponding end position is illustrated in dotted outline in FIGS. 9 and 12. As seen in FIGS. 9 and 12, the arm support pads of the upper torso support move from start position 56A to end position 56B during an exercise, and position 56B is rotated downward and slightly forward from position 56A while maintaining the user's lower arms in approximately the same orientation.

The lifting of the exercise arm 16 by the leg against the resistance or load provided by the selectorized weight stack 22 in the controlled motion illustrated in FIGS. 10 to 12 engages and exercises the gluteus maximus and medius muscles. At the same time, the upper torso is slightly rotated downward and forward, as seen in FIGS. 11 and 12, which relieves the stress on the thoracic and lumbar vertebrae that otherwise might be incurred by the upward leg rotation if the upper torso remained in the same position throughout the exercise. This torso movement also challenges the body's core muscles to stabilize. After completing one glute exercise, the user moves their leg and the exercise arm back towards the start position, and repeats the exercise for the desired number of repetitions. After completing a desired number of repetitions of the glute exercise with the right leg as in FIGS. 10 to 12, the user can exit the machine and then pivot the knee support to the right hand position of FIG. 5, and then reposition themselves in the opposite position from that of FIG. 10 so that the right knee and shin engage support pad 40 and the left foot engages between safety roller 92 and footrest 90 of the foot support, and repeat the exercise using the opposite knee and leg.

As noted above, the four bar pivot linkage supporting the upper torso support 14 controls the movement of the support during an exercise and is configured to define a slight downward and forward motion of the upper torso support. FIGS. 10 to 12 illustrates the movement of the upper torso support or user support 14 between the start position illustrated in solid line in FIG. 12 and an end position, such as the exemplary end position illustrated in FIG. 11 and in dotted line in FIG. 12.

In the above embodiment, movement of the user engagement device or exercise arm is translated into rocking movement of a user support, making the exercise more enjoyable for the user. Additionally, the linked relationship between the movement of the exercise arm and the movement of the user support is designed so that movement of the user support tracks movement of the exercise arm and keeps the user in better alignment during the exercise, providing better exercise of the gluteus muscles while reducing potential stress on the thoracic and lumbar vertebrae of the back and also engaging the user's core body muscles in the exercise. The user support or upper torso support rocks slightly downward and forward as a user performs the glute exercise pushing user engaging end of the exercise arm, along with the user's foot, upward and rearward. This provides a more comfortable, better feeling exercise that enhances the user's workout.

It should be understood that all the different elements used in the above embodiment may be mixed and interchanged with one another and still incorporate the essence of the above embodiments. The exercise arm may be mounted on the main frame, user support or connecting link. The footrest pad and capture rollers could be replaced with a lower leg or ankle engaging device. The connecting linkage could be made adjustable and the linkage could be replaced by a cable. Cables could be replaced with belts, ropes, chains, or the like, and pulleys could be replaced with sprockets. The upper torso engaging pads could be fixed or made adjustable relative to the supporting frame.

The exercise resistance may be associated with any of the moving parts (user support, user engagement device, or connecting linkage). The exercise resistance may be a weight stack as in the above embodiment, or may be any other type of resistance known in the art, such as weight plates, elastic bands, or pneumatic, electromagnetic, or hydraulic resistance. The glute exercise machine may be stand alone machine or may be part of a multi-station gym.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

We claim:

1. A glute exercise machine, comprising:

a stationary main frame having a forward end and a rear end;

a user support assembly on the main frame configured to support a user in a glute exercise position facing forward, the user support assembly comprising an upper torso support and a knee support spaced rearward from the upper torso support, the upper torso support movably mounted relative to the main frame and configured to support the upper torso of a user in a glute exercise position, the knee support configured to support the right or left knee of a user in a respective right or left kneeling position when the upper torso is supported on the upper torso support;

an exercise arm assembly movably mounted relative to the main frame and knee support and having a foot engaging portion which is adapted for operation by one foot of one leg only of a user to move the foot engaging portion in a glute exercise path during a glute exercise while the other leg is supported in the respective right or left kneeling position on the knee support and the user is supported in a glute exercise position on the user support assembly;

a connecting linkage which translates movement of the exercise arm assembly during a glute exercise into rocking movement of the upper torso support; and a load which resists movement of at least one of the exercise arm assembly, the upper torso support, and the connecting linkage.

2. The apparatus of claim 1, further comprising a knee support pivot mount pivotally mounting the knee support on the main frame for side-to-side rotation between a left knee support position configured for supporting the left knee of a user in the left kneeling position and a right knee support position configured for supporting the right knee of a user in the right kneeling position.

3. The apparatus of claim 2, wherein the knee support includes a gravity stop mechanism which defines the left and right knee support positions, the knee support being freely rotatable by a user between the left and right knee support positions.

4. The apparatus of claim 3, wherein the knee support pivot mount comprises a four bar pivot linkage between the knee support and main frame having first and second parallel pivot links each pivoted to the main frame for rotation about a first pair of parallel pivot axes and pivoted directly to the knee support for rotation about a second pair of parallel pivot axes which are parallel to the first pair of pivot axes.

5. The apparatus of claim 4, wherein the gravity stop mechanism comprises a stop member attached to the first pivot link and located between the pivot links, the stop member configured to engage the second pivot link and act as a stop in the left and right knee support positions.

6. The apparatus of claim 1, wherein the upper torso support comprises a support frame, a left arm support pad on the support frame configured to support a user's left arm and a right arm support pad on the support frame configured to support a user's right arm.

7. The apparatus of claim 6, wherein the upper torso support further comprises left and right handles, respectively, located in front of the right and left arm support pads and configured for gripping by a user during a glute exercise.

8. The apparatus of claim 1, wherein the upper torso support is configured to move downward and forward during a glute exercise.

9. The apparatus of claim 1, wherein the exercise arm assembly has a first arm portion pivoted to the main frame at a first location spaced above the user support assembly and a second arm portion depending generally downward from the first arm portion, the second arm portion carrying the foot engaging portion.

10. The apparatus of claim 9, wherein the second arm portion is pivotally secured to the first arm portion at location spaced rearward from the first location and the exercise arm assembly further comprises a range of motion (ROM) adjustment mechanism configured to secure the second arm portion at a selected orientation relative to the first arm portion, whereby a start position of the foot engaging portion can be adjusted to accommodate users with different leg lengths.

11. The apparatus of claim 1, wherein the connecting linkage comprises a drive link pivotally associated with the exercise arm assembly and the upper torso support, whereby movement of said exercise arm assembly in an exercise path corresponding to the glute exercise simultaneously moves said upper torso support in a predetermined path.

12. The apparatus of claim 11, wherein the drive link has an upper end pivotally connected to the exercise arm assembly and a lower end portion pivotally linked to the upper torso support.

13. The apparatus of claim 12, further comprising a pivot linkage between the upper torso support and lower end portion of the drive link.

14. The apparatus of claim 11, further comprising a four bar pivot linkage between the upper torso support, the main frame, and the connecting linkage.

15. The apparatus of claim 12, wherein the connecting linkage further comprises a cross bar pivotally connected to the lower end portion of the drive link and extending transversely from the drive link.

16. The apparatus of claim 15, further comprising a pivot assembly which pivotally links the upper torso support to the main frame and cross bar.

17. The apparatus of claim 1, wherein said connecting linkage comprises a multi-part connecting linkage.

18. The apparatus of claim 1, further comprising a pivot assembly which pivotally mounts the upper torso support on the main frame.

19. The apparatus of claim 18, wherein the upper torso support has at least one user engaging portion configured for engagement by the arms of a user and the pivot assembly is configured to move the upper torso support downward and forward in response to movement of the exercise arm assembly during the glute exercise while maintaining the user engaging portion at the same orientation relative to the main frame.

20. The apparatus of claim 19, wherein the pivot assembly comprises a four bar linkage comprising at least one first link pivoted to the upper torso support for rotation about a first pivot axis and to the main frame for rotation about a second pivot axis spaced rearward from the first pivot axis, and at least one second link pivoted to the upper torso support for rotation about a third pivot axis spaced from the first pivot axis and pivoted to the connecting linkage for rotation about a fourth pivot axis spaced rearward from the third pivot axis.

21. The apparatus of claim 20, wherein the second link is pivoted to the main frame for rotation about a fifth pivot axis at a location between the third and fourth pivot axes.

22. The apparatus of claim 1, wherein the connecting linkage is connected to the load.

23. The apparatus of claim 1, wherein the load comprises a selectorized weight stack.

24. A glute exercise machine, comprising:

a stationary main frame having a forward end and a rear end;

an upper torso support movably mounted on the main frame and configured to support a user in a forward facing glute exercise position;

a knee support spaced rearward from the upper torso support and configured to support the right or left knee of a user in a respective right or left kneeling position when the upper torso is supported on the upper torso support;

an exercise arm assembly movably mounted relative to the main frame and knee support and having a foot engaging portion spaced above and rearward from the knee support which is adapted for operation by one foot of one leg only of a user to move the foot engaging portion rearwards in a glute exercise path during a glute exercise while the other leg is supported in the respective right or left kneeling position on the knee support and the user is supported in a glute exercise position on the upper torso support and knee support;

a connecting linkage which translates movement of the exercise arm assembly during a glute exercise into rocking movement of the upper torso support; and a load which resists movement of at least one of the exercise arm assembly, the upper torso support, and the connecting linkage.

* * * * *